United States Patent [19]

Kauffeldt

[11] 4,233,706

[45] Nov. 18, 1980

[54] APPARATUS FOR CLEANING OF LARGE SCALE TEXTILE COVERINGS, ESPECIALLY CARPETS AND WALL TO WALL CARPETING

[76] Inventor: Horst Kauffeldt, Bachstr. 150, 4000 Düsseldorf, Fed. Rep. of Germany

[21] Appl. No.: 946,287

[22] Filed: Sep. 27, 1978

[30] Foreign Application Priority Data

Sep. 28, 1977 [DE] Fed. Rep. of Germany ..... 2743530

[51] Int. Cl.[3] ..... A47L 7/00

[52] U.S. Cl. ..... 15/300 A; 15/353; 55/171; 55/470

[58] Field of Search ..... 15/320, 321, 353, 300 A; 55/171, 343, 419, 470

[56] References Cited

U.S. PATENT DOCUMENTS

| | | | |
|---|---|---|---|
| 2,635,278 | 4/1953 | Belknap | 15/320 X |
| 3,683,447 | 8/1972 | Stevenson | 15/320 X |
| 3,736,619 | 6/1973 | Zamboni | 15/353 X |
| 3,774,260 | 11/1973 | Emus, Jr. | 15/353 X |
| 3,974,541 | 8/1976 | Silvis et al. | 15/320 |
| 4,087,881 | 5/1978 | Bates | 15/300 A |

*Primary Examiner*—Christopher K. Moore

*Attorney, Agent, or Firm*—Sprung, Felfe, Horn, Lynch & Kramer

[57] ABSTRACT

An improvement is disclosed in an apparatus of the type employed for cleaning textile coverings, especially rugs and carpeting where the apparatus is provided with at least one spray jet connected to a supply of cleaning fluid and a suction jet is connected to a dirt-laden fluid receptacle. Apparatuses of this type have at least one suction turbine connected to and actuated by a motor where the suction turbine has a suction pipe in fluid communication with a receptacle for dirt-laden fluid typically dirty water. According to the invention, the receptacle for the dirt-laden fluid is divided into a plurality of interconnecting vacuum chambers by use of vertically disposed partitions, each of which vacuum chambers is in fluid communication with a common sump disposed therebeneath. The partitions extend vertically over most of the height of the chambers. Each of the vacuum chambers is in fluid communication with its own suction turbine via a suction pipe entering the vacuum chamber. The suction pipe, in turn, is in fluid communication with a suction jet. A discharge pipe is provided for discharge of dirt-laden fluid in the common sump.

12 Claims, 12 Drawing Figures

FIG. 8
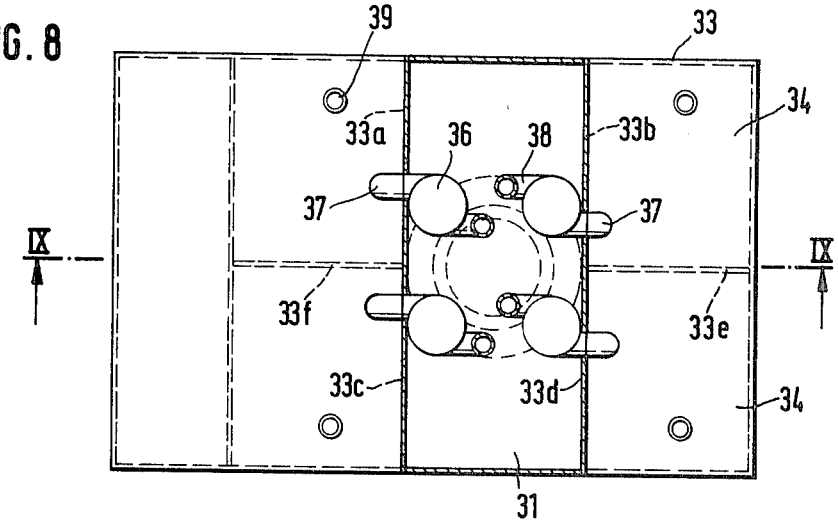
FIG. 9
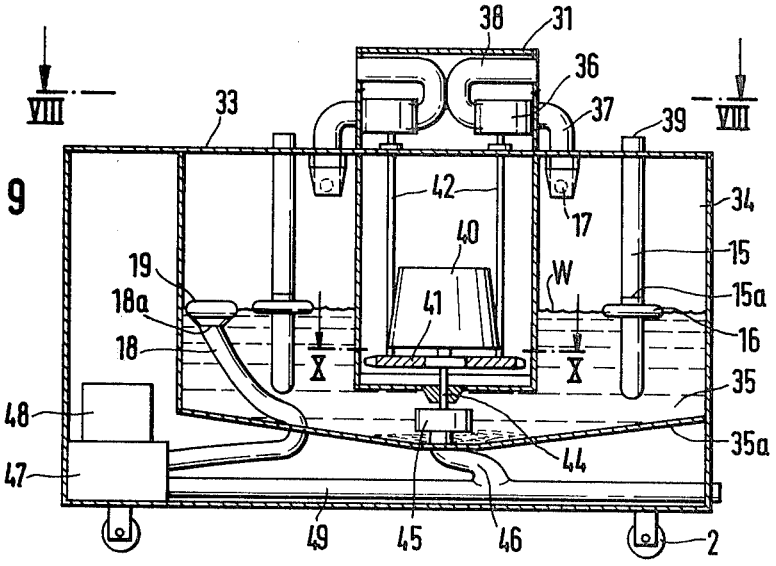
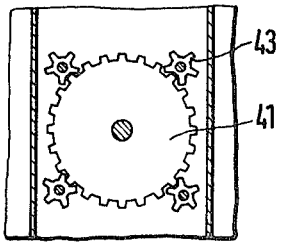
FIG. 10

APPARATUS FOR CLEANING OF LARGE SCALE TEXTILE COVERINGS, ESPECIALLY CARPETS AND WALL TO WALL CARPETING

BACKGROUND OF THE INVENTION

Field of the Invention

This invention relates to an apparatus for cleaning textile covering materials, including upholstery, carpets, rugs, wall to wall carpeting and the like, by an apparatus which comprises a spray jet for spraying a cleaning fluid onto the textile covering material and a suction nozzle for removal of dirt-laden fluid. More particularly, this invention is directed to an apparatus for cleaning large-scale textile coverings, especially carpets and wall to wall carpeting, with at least one spray nozzle connected to a fresh water conduit and a suction jet connected to a dirty water receptacle, which apparatus is provided with suction turbines powered by electric motors whose suction pipes are connected with the interior of a dirty water receptacle.

Such equipment is well known, i.e., carpets or wall to wall carpeting are cleaned with them in such a way that fresh water, in some instances heated or mixed with a cleaning solvent, is sprayed under high pressure on the carpet and is vacuumed up after a relatively short time of acting upon it. The vacuuming is done by using a suction jet which is connected to the dirty water receptacle mentioned above. By using suction turbines in the dirty water receptacle, a vacuum is created whereby the air current which flows steadily back to the dirty water receptacle pulls back the dirty water in single droplets when the suction nozzle is placed on the carpet or wall to wall carpeting. In this way, a good suction effect is achieved. The dirty water accumulates in the dirty water receptacle and is drawn off or pumped out from time to time.

This type of equipment is commercially available as compact units with adjustable suction nozzle connected via flexible hoses. Available equipment of this type suffers from a series of disadvantages which seriously affect optimum performance.

It has been proved that, for instance, in order to obtain a sufficient vacuum, exceptionally high powered suction turbines with corresponding strong motors must be used. In known models each turbine is equipped with its own motor.

All suction turbines combined act upon the same interior space of the dirty water receptacle and their effect on each other has proven detrimental in terms of efficiency. Furthermore, this type of use of suction turbines is quite expensive and leads to high production costs for the entire equipment. Another disadvantage of the existing equipment consists in that the dirty water receptacle has to be emptied out from time to time which means that the accumulating dirty water has to be drawn off or pumped out. Since the machinery has to be kept mobile to a certain extent, the dirty water receptacle cannot be designed unreasonably large. The discharge of the dirty water receptacle after cleaning large areas interrupts the working process too frequently.

It is an object of this invention to provide improved equipment of the type described above which is improved in respect of its suction power and of a means for the discharge of dirt-laden fluid whereby effective and continuous performance of the cleaning function can be achieved with concomitant reduction in the cost of apparatus manufacture.

SUMMARY OF THE INVENTION

The foregoing objects are provided in an apparatus for cleaning of textile covering material, especially carpets and carpeting, having at least one spray jet connected to a supply of cleaning fluid and a suction nozzle connected to a dirt-laden fluid receptacle, at least one suction turbine connected to and actuated by a motor, said suction turbine having a suction pipe in fluid communication with a receptacle for dirt-laden fluid, the improvement residing in that the receptacle comprises a plurality of interconnecting vacuum chambers separated by vertically disposed partitions, each of which chambers is in fluid communication with a common sump disposed therebeneath, said partitions extending vertically over most of the height of the chambers, each of said vacuum chambers being in fluid communication with a suction turbine via a suction pipe entering therein, and each vacuum chamber being in fluid communication with a suction nozzle via a dirty water pipe, said common sump being connected to a discharge pipe.

It will be apparent that the apparatus of the present invention can be employed using a wide variety of different cleaning materials. For instance, water or water containing surfactants, softening agents or the like can be employed. Alternatively, solvents or organic cleaning materials can also be used. The invention resides in the means by which the dirt-laden fluid, e.g., dirty water, is removed from the surface of the textile covering material. Hence, the invention will be described with reference to the removal of dirt-laden water (dirty water), it being realized that the apparatus is useful for a wide variety of cleaning fluids, especially cleaning liquids. Furthermore, the invention is useful for those apparatuses useful in cleaning textile upholstery material, as well as rugs, carpets and carpeting. The invention will be described with particular reference to rug and carpet cleaning apparatuses.

According to the invention, the problem attendant the prior art apparatus is solved by dividing the interior of the dirty water receptacle into at least two interconnecting chambers (i.e., at least two vacuum chambers and a common sump) by at least one partition which extends from the upper cover vertically down for some portion of its height, whereby one chamber serves as a collection receptacle (sump) situated below the others which serve as vacuum chambers and are each equipped with a suction turbine whose suction pipes extend from the tip into the corresponding vacuum chamber from where a dirty water pipe is connected to the suction nozzle while the collection receptacle is connected to a dirty water discharge pipe.

According to the invention, advantageous types of construction for the equipment are possible. For instance, the suction turbines can be powered by a single electric motor via transmission gears. In this case, the electric motor can be connected to a transmission with universal drive shaft to which the drive shafts of the suction turbines are connected in pairs via transmission gears. The torque-transfer from the electric motor to the suction turbines can also be achieved by using a flexible drive shaft.

Furthermore, the apparatus of the invention permits removal of dirty, water from the dirty water receptacle in an especially favorable and continuous way whereby it is no longer necessary to interrupt the working procedure to discharge the dirty water.

BRIEF DESCRIPTION OF DRAWINGS

According to the invention, further characteristics and advantages of the equipment are presented in the following description of construction examples by means of the accompanying drawings.

FIG. 8 shows a section cut along line VIII—VIII in FIG. 9 of another construction form of the apparatus of the invention;

FIG. 9 is a section cut out along line IX—IX in FIG. 8;

FIG. 10 is a section cut along line X—X in FIG. 9;

DESCRIPTION OF SPECIFIC EMBODIMENTS

Figure 1:
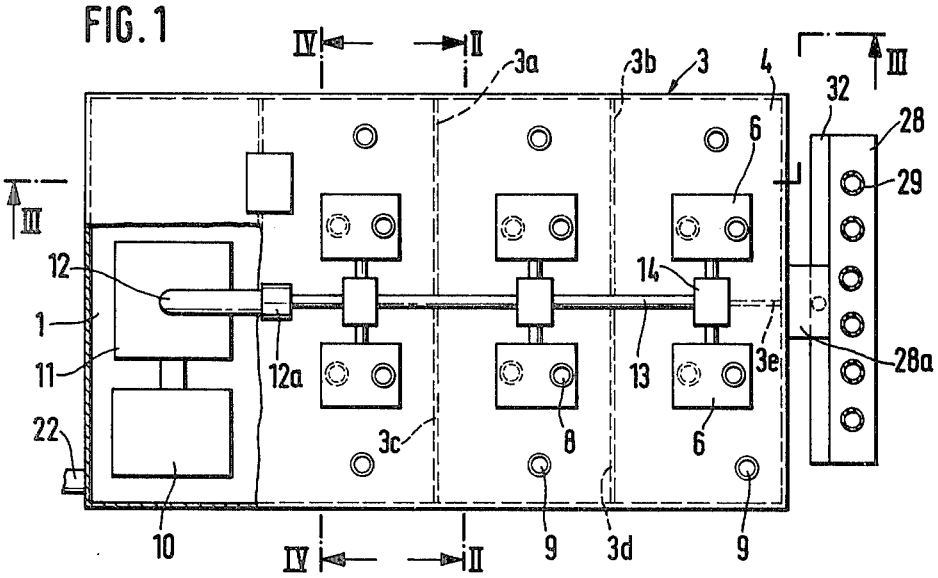
FIG. 1 shows in strictly schematic representation one construction form of the apparatus of the invention with partially removed cover plate.

The equipment represented in FIGS. 1 to 7 shows a dirty water receptacle 3 and a power unit 1 which are combined together to form a compact machinery running on rollers 2.

According to FIGS. 1 to 4, the interior of the dirty water receptacle 3 is divided into various chambers by partitions 3*a* to 3*g* which start from the top of the equipment and lead in vertical direction into the dirty water receptacle, reaching more than ¾ the height of it, whereby the chambers situated on the upper part of the receptacle 3 are marked as vacuum chambers 4 while the chamber situated in the lower part of the interior and connecting all vacuum chambers is marked as collecting receptacle 5. The collecting receptacle 5 shows a bottom 5*a* which slopes towards the center in order to collect the resulting dirty water at the lowest point.

Above the vacuum chambers 4 are suction turbines 6 placed within a housing 38 (removed in FIG. 1) whose flanged suction pipes 7 lead to the corresponding vacuum chamber 4 while the blower nozzles are pointing outwardly.

The suction turbines 6 are situated in such a way that each of the vacuum chambers is equipped with its own suction turbine 6.

In the construction form represented in FIGS. 1 to 4, the powering of the suction turbines 6 is performed by a single, accordingly large-dimensioned, electric motor 10. The drive shaft of this electric motor 10 is connected via transmission gearing 11 to a flexible shaft 12 which acts via a connecting gear upon a transmission shaft 13 leading along the top of the equipment. Connected to this transmission shaft 13 via transmission gearing are the drive shafts of the suction turbines 6 which are arranged in pairs, i.e., as in differential gearing.

The vacuum chambers 4 are connected to the outside via flanged intake sockets 9. Inside each vacuum chamber 4, flexible hoses 15 are connected to the intake sockets which carry a float 16 on the free end. In front of the flanged intake sockets 7 of the suction turbines 6 are ball valves 17 in basket-supports whose function is described at a later point.

Figure 2:
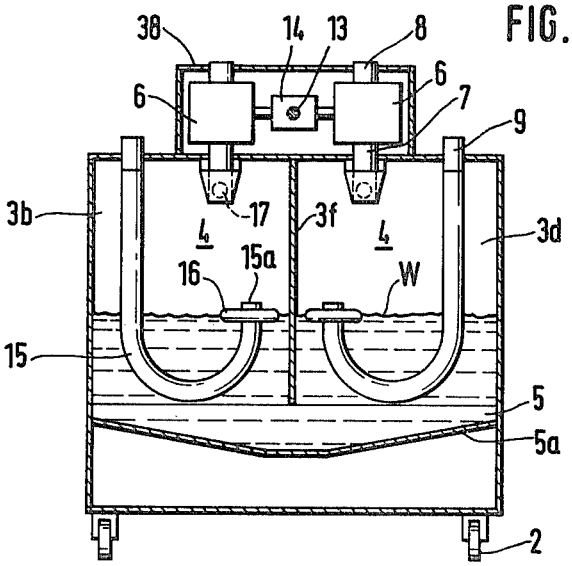
FIG. 2 is a section cut along line II—II in FIG. 1.
Figure 3:
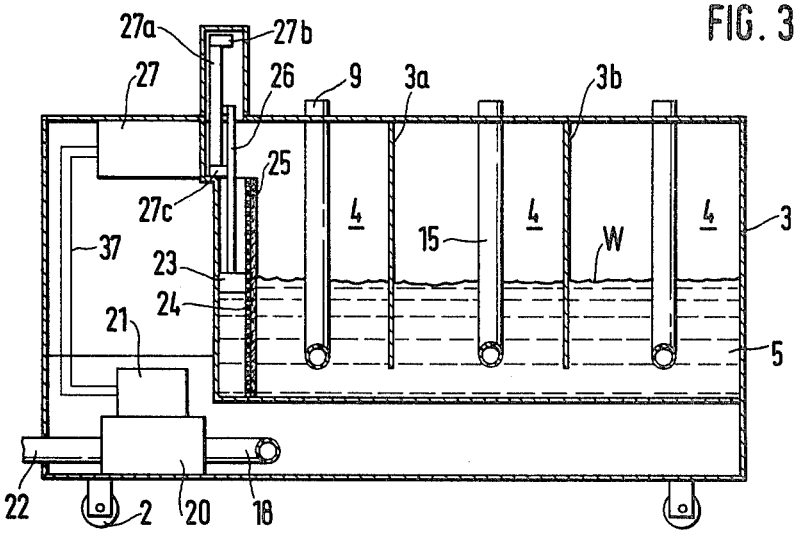
FIG. 3 is a section cut along line III—III in FIG. 1.

Dirty water conduits 29 can be connected to the outside of the flanged intake sockets 9 which are not shown in FIGS. 1 to 3. These dirty water conduits, used, i.e., as suction hoses, lead to a suction nozzle 28 which is solidly attached to the equipment. This is shown in more detail in FIG. 7. The dirty water conduits 29 are purposefully combined into a conducting strand and extend in this way to the suction nozzle 28.

One can also extend the dirty water conduits to a stream lined flanged collection socket to which a suction hose can be connected, leading to a suction nozzle which could be handled separately from the unit.

Figure 7:
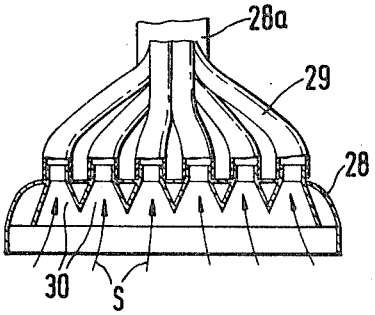
FIG. 7 shows a front section cut of a suction turbine used in the apparatus of the invention according to FIGS. 1 to 6.

The suction nozzle 28 shown in FIG. 7 is equipped with several single nozzles to which accordingly one of the hoses 29 is connected. Furthermore, according to FIG. 1, a fresh water pipe 32 with downward pointed outlet jets is attached to the suction nozzle 28, which is connected with a fresh water intake hose (not shown) to a fresh water source. The fresh water source could be the water faucet itself. Before spraying, it has generally proven useful to feed the fresh water to a special unit where it is heated or, in some instances, mixed with cleaning solvents from where it can be directed to the fresh water pipe 32 by means of an additional pump. Such a unit is not shown in the representation since it actually is not part of the invention. By all means, it can be incorporated into the compact equipment shown in FIGS. 1 to 4.

Figure 4:
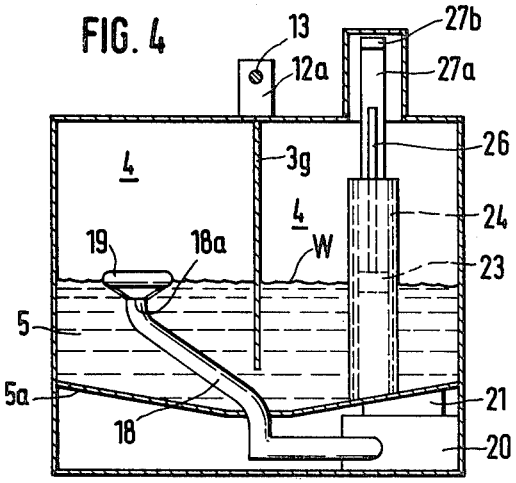
FIG. 4 is a section cut along line IV—IV in FIG. 1.

For the discharging of the dirty water from the dirty water receptacle, a pipe 18 is used which is flexible at least on its inner end and is equipped with a float 19 near its inlet 18*a* (FIG. 4). The pipe 18 is connected to a pump 20 powered by an electric motor 21 from where another pipe 22 leads towards the outside to be connected to a drain or sewer not shown in the drawing.

As explained in further detail below, a float 23 (FIGS. 3 and 4) sliding, e.g., in a guide 24 shaped like a perforated tube, acts via rod 26 upon the movable contact of a linear potentiometer 27*a* which triggers an electric regulator 27 which acts upon the motor 21 of the pump 20 via an electric circuit 37. A strainer 25 (FIG. 3) surrounding the sliding guide 24 prevents the entering of large dirt particles which might affect the functioning of the float 23.

In place of the strainer a closed separation wall running parallel to the sliding guide 24 can be used which is equipped with at least one opening at the bottom covered with a strainer. In this way a disfunctioning of the float 23 due to wave movements or turbulence is prevented.

Figure 5:
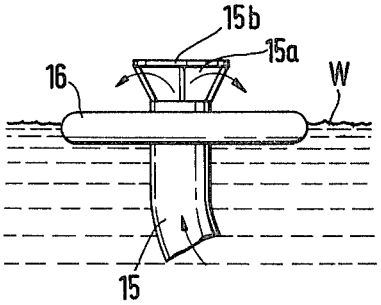
FIG. 5 and FIG. 6 show in side view as well as front view one particular detail of the dirty water intake conduit of the equipment according to FIGS. 1 to 4.
Figure 6:
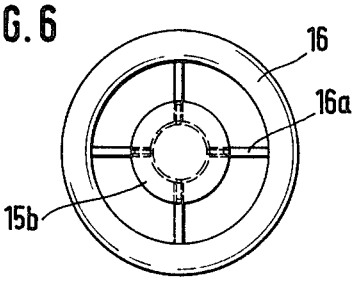

In FIG. 5 and FIG. 6 the free ends of the flexible conduits 15 are shown on a larger scale, and are connected via supporting rods 16*a* to the float 16. Above the outlet 15*a* of each conduit 15 a deflector plate 15*b* is affixed.

In the following passages the functions of the equipment presented in FIGS. 1 to 7 is explained in more detail.

For the cleaning of carpets or wall to wall carpeting the equipment and the suction nozzle 28 are placed on the carpet and fresh water is sprayed on the carpet from the outlet jets of the hose 32. The motor 10 is switched on and a vacuum is produced in the vacuum chambers 4 by the suction turbines 6 powered by the motor. This vacuum transfers via the flanged intake sockets 9 and the suction hoses 29 to the intake nozzle 30 of the suction nozzle 28. A mixture of air and dirty water is pulled through the nozzle 30 in the direction of the arrow S (FIG. 7) and flows through the suction hoses 29, the intake socket 9, the flexible conduits 15 and through their exit opening 15*a* into the vacuum chambers. The water which was pulled along accumulates in the collecting receptacle 5, while the air which was pulled along is carried to the outside by suction turbines 6.

In time, the dirty water level W rises in the receptacle 5 up into the vacuum chambers 4. By means of the floats 16 the exit openings 15*a* of the conduts 15 are raised right along side and are held closely above the dirty water level W. The deflector plate 15*b* (FIG. 5) has the job of turning the water which has been pulled along back to the dirty water surface W, and not to let it spray into the inside of the vacuum chamber 4 or even in the direction of the suction intake sockets 7 of the suction turbines 6. The placement of the exit opening 15*a* close above the dirty water level W serves the purpose of preventing large turbulence in the accumulating dirty water and subduing the formation of foam. In case the dirty water level rises too quickly and results in the danger for the suction turbines 6 to draw water rather than air, the above-mentioned ball valves 17 are placed in front of the suction intake sockets 7, which would close in this particular instance.

In order not to have to pump out the dirty water receptacle from time to time, as is the case with other known equipment, the dirty water removal is automatically regulated. The dirty water level W raises the float 23 (FIGS. 3 and 4) which via a regulator not only switches on the electric motor 21 to work the pump 20 but, during fast rising dirty water level, increases the velocity of the motor 21 which in turn increases the velocity of the pump. The dirty water flows through the intake opening 18*a* of the flexible hose into the conduit and is pumped by the pump 20 through the conduit 22 continuously to the outside. By means of the float, the intake opening 18*a* of the flexible conduit 18 is held close below the dirty water surface W which has the advantage of suctioning off the dirty water right then and there, where the fewest heavy deposits are. These accumulate much more at the bottom of the collecting receptacle 5 and can be removed intermittently and separately.

The regulation of the dirty water removal should be tuned in such a way as to keep the dirty water level W during operation of the equipment from sinking below the bottom edge of the partitions 3*a* to 3*g*, in order to keep the vacuum chambers 4 as separate vacuums in regard to their individual effectiveness. By all means, the dirty water level must be prevented from rising too quickly. A limit switch 27*b* (FIG. 3) can be used either to cut off the fresh water supply, or to activate an auxiliary pump (not shown here but further down) by means of another construction example. Another limit switch 27*c* regulates the turning off of the pump 20.

Of course, there are also other forms of construction possible than the invented unit shown in FIGS. 1 to 7.

For example, using simpler construction form, one may disregard the velocity regulation of the pump 20 which at regulated velocity would be a cog wheel pump. The float 23 activates just one or more end switches which turn the pump 20 on and off. In this case, the pump 20 may be a circulating pump.

Instead of a float, one could naturally use an electronic sensor to measure the dirty water level and to produce an electronic activating signal.

In FIGS. 8 to 10, another form of construction of the apparatus of the invention is shown. This form differs from the construction form shown in FIGS. 1 to 7 through a different layout of the power unit with respect to the vacuum chambers which offers an especially advantageous way of powering the suction turbines, as well as in details of the dirty water removal.

The equipment represented in FIGS. 8 to 10 shows a power source 31 and a dirty water collection receptacle 33. The dirt water collection receptacle 33, similar to the construction described above, is divided by vertical partitions 33*a* to 33*f*, this time into a total of five chambers. The power source is situated in such a way that the vacuum chambers 34 are placed in pairs to either side of the power source 31 and the collection receptacle 35 with its bottom declining toward the center, running below the vacuum chambers 34 and the power source 31.

This time, the suction turbines 36 are placed above the power source 31 and their suction intake sockets 37 lead through elbows or e.g. inter-connecting suction hoses into the vacuum chambers 34. Inside the vacuum chambers 34, ball valves 17 are placed in front of the suction intake sockets 37 of the suction turbines 36.

In this form of construction, the powering of the suction turbines 36 is carried out by an electric motor 40 which powers a transmission consisting of a cog wheel 41 sitting on the drive shaft of the motor (see FIG. 10) and locking into four smaller cog wheels 43. A flexible shaft 42 leads from each of these cog wheels 43 to one of each drive shafts of each suction turbine 36. This form of construction has the tremendous advantage of avoiding any difficulties which might appear during supporting or adjusting the power source for the suction turbines which might occur at high rotation speed when using stiff shafts.

The blower nozzles 38 of the suction turbines 36 face the outside.

The vacuum chambers 34 are connected via intake sockets 39 with the outside. Flexible conduts 15 whose exit openings 15*a* are held above the dirty water level W by a float 16, are attached on the inside of the vacuum chambers 34 in the same way as shown in the construction form according to FIGS. 1 to 7. Dirty water hoses are connected to the outside of the intake sockets 39 which either lead to a suction nozzle rigidly attached to the equipment according to the construction form shown in FIGS. 1 to 7, or can be connected to a collecting socket (not shown) connected via pressure hose to a movable suction nozzle.

In this construction form, the dirty water removal is carried out in two different ways. It can be done with a flexible conduit 18, whose intake end 18*a* is held closely below the dirty water level W by means of a float 19.

The dirty water is pumped by a cog wheel pump 47 powered by a motor 48 into the dirty water discharge conduit 49 which leads to the outside. The motor 48 and the pump 47 can be activated in a similar way as described in FIGS. 1 to 7. In FIGS. 8 to 10, the float as well as the equipment activated by it are not shown separately. They are analogous to the construction form described previously.

Additionally, a circulating pump 45 situated inside the collection receptacle 35 can be connected via a shaft directly to the electric motor 40. The pump 45 runs steadily as long as the motor 40 powering the suction turbines 36 is activated. Under normal conditions it works a dirty water circulator and acts as an auxiliary pump in emergency situations. Should the water level W rise too quickly because of too much dirty water accumulation, a limit switch 27*b* activated in this way by the float 23 (see FIGS. 3 and 4) will trigger a magnetic valve through which the dirty water circulator is coupled with the dirty water discharge 46 which leads into the discharge conduit 49. In addition, the dirty water present in the collection receptacle 35 is pumped out by the pump 45. Naturally, the opening of the dirty water cycle can be activated by a mechanically triggered valve.

The on and off switching of the additional circulating pump 45 can be activated by a time switch which turns the pump on for a pre-set time interval when heavy dirty water accumulation occurs.

Solid particles accumulating at the lowest point of the collection receptacle can be removed from time to time.

Figure 11:
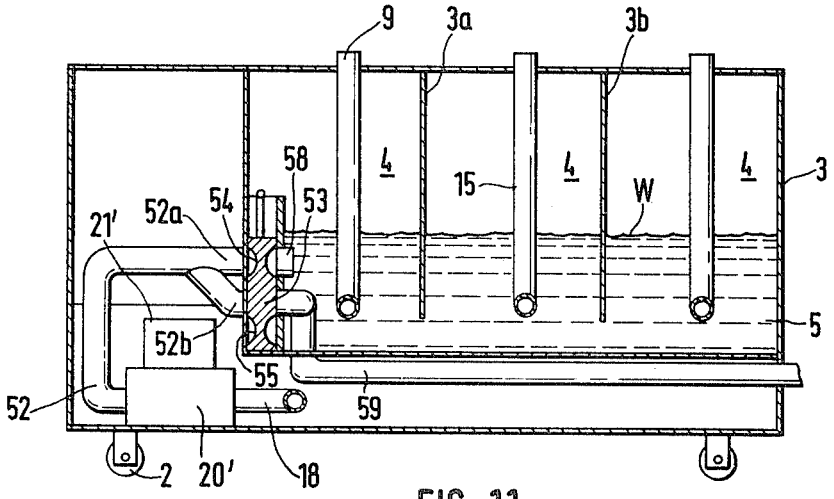
FIG. 11 is a section cut along line III—III in FIG. 1 in an alternative construction form according to FIG. 1.
Figure 12:
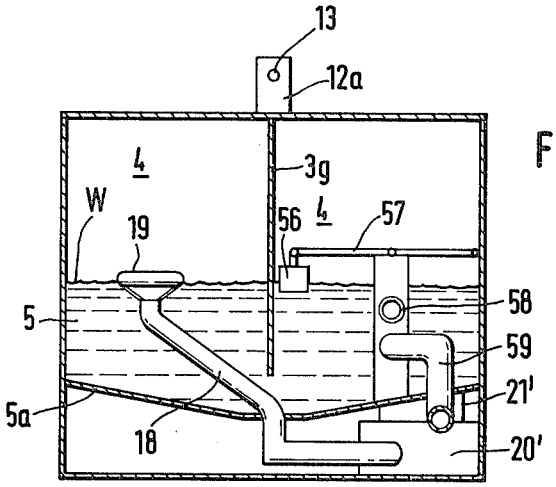
FIG. 12 is a cut along line IV—IV in FIG. 1 of the same alternative as represented in FIG. 11.

A variation of the construction form shown in FIGS. 1 to 7 is presented in FIGS. 11 and 12. Similar parts are hereby labeled with similar reference numerals.

The difference of the construction form shown in FIGS. 11 and 12 in comparison to the construction form shown in FIGS. 1 to 7 consists in the type of dirty water removal. While according to the construction form shown in FIGS. 3 and 4 the powering of the pump 20, as well as the velocity of the electric motor 21 is regulated by the float 23 and the regulating installation 27, depending on the level of the dirty water surface W, the construction form according to FIGS. 11 and 12 uses a pump 20' which is powered by an electric motor 21 and which runs steadily during operation at a fixed rate of velocity. The dirty water flows from the collection receptacle 5 through the intake opening 18*a* (of the type shown in FIGS. 4 and 9) into the conduit 18 to the pump 20'. From the pump 20' it is carried through a conduit 52 back to the collection receptacle 5. Inside the collection receptacle is a slide valve 53 which is equipped with two passage openings 54 and 55. The conduit 52 forms a Y. One part 52*a* connects to the passage opening 54, the other part 52*b* connects to the passage opening 55 of the slide valve 53. The slide valve 53 is moved via rod 57 by a float 56 floating on top of the water surface W in the collection receptacle 5. At relative low water level W, the conduit 52 connects via the passage opening 54 to an outlet socket 58, situated inside the collecting receptacle 5. In this position, the pump 20 works as a dirty water circulator. It also moves the dirty water pumped out of the collection receptacle 5 back to the receptacle 5. When the dirty water level begins to rise, the slide valve gets activated by the float 56 whereby the passage opening 55 makes connection with the conduit 52. In this position of the slide valve 53, the dirty water is drawn from the receptacle 5 by the pump 20' and is moved to the outside via a conduit 59. This type of construction has the advantage of especially low technical expenditures. There are no electrical control circuits necessary and the activation of the slide valve is done in purely mechanical fashion.

In practice it has proven purposeful to activate the dirty water discharge of the last-mentioned or other types of the invented construction in such a way as to subject the dirty water surface W to almost no fluctuation in order to keep the the interior of the vacuum chambers 4 above the dirty water surface W at an almost constant vacuum during operation.

Besides great effectiveness in performance and in construction costs, all types of the invented construction have the huge advantage of being built comparatively small, since, because of their capability to continuously discharge dirty water, the collection receptacle as well as the vacuum chambers need only to occupy a relatively small space. In this way it is possible to feature the equipment as a space-saving and reasonably-priced household article.

I claim:

1. An apparatus for cleaning textile covering materials comprising a dirt laden fluid receptacle, said dirt laden fluid receptacle comprising a plurality of vertically disposed partitions depending from the top of said receptacle, but being in out of contact relationship with the bottom of said receptacle whereby there is defined a plurality of vacuum chambers disposed over a common sump, each of said vacuum chambers being in fluid communication with a common suction nozzle via a dirty water pipe disposed therebetween, said vacuum chambers being connected via a suction conduit to at least one suction turbine connected to and activated by a motor, said apparatus having at least one spray jet connected to a supply of cleaning fluid.

2. An apparatus according to claim 1 wherein said apparatus comprises means for maintaining the level of dirty water in said receptacle while in operation at a predetermined level above the lower edge of said partitions.

3. Apparatus according to claim 2 wherein said partitions extend at least $\frac{3}{4}$ of the total height of said receptacle.

4. Apparatus according to claim 2 wherein each suction turbine is attached to and actuated by a single electric motor.

5. Apparatus according to claim 2 wherein each of said dirty water pipes is conected with its vacuum chamber to a flexible generally U-shaped pipe whose terminal end away from said dirty water pipe is attached to a float such that the discharge outlet of said flexible pipe is disposed above the surface of any dirt-laden fluid therein.

6. Apparatus according to claim 2 wherein each of said dirty water pipes is in fluid communication with a suction nozzle comprising a plurality of individual nozzles.

7. An apparatus according to claim 2 wherein there are a plurality of suction turbines each of which is mated with a corresponding one of said vacuum chambers and each of which has a drive shaft and said drive shafts are matingly connected in pairs to a single shaft which in turn is connected to said electric motor.

8. An apparatus according to claim 2 wherein said dirt laden fluid receptacle has a discharge port and said discharge port is in fluid communication with a pump.

9. Apparatus according to claim 8 wherein said discharge port comprises a discharge conduit connected within said receptacle to a flexible pipe having an intake port equipped with a float disposed on said intake port such that said intake port lies just below the surface of any dirt-laden fluid in said receptacle.

10. An apparatus according to claim 2 wherein said means for regulating the level of dirty water in said receptacle comprises a float disposed inside said dirt laden fluid receptacle, which float is connected, via a lever system, to a control device for an electric motor, which electric motor is connected to and actuates a pump in a fluid conduit connected to said discharge port in said dirt laden fluid receptacle.

11. An apparatus according to claim 10 wherein said float is disposed inside one of said vacuum chambers and runs in a guide, the path of said float being separated from the balance of the vacuum chamber by means of a dirt collecting screen.

12. An apparatus according to claim 2 wherein said means for maintaining the level of dirty water comprises a float inside the dirt laden fluid receptacle which, over a lever system, controls a slide which, at a given position of the float, connects a dirty liquid circuit driven by a pump to a dirty water discharge pipe.

* * * * *